US010449464B2

(12) United States Patent
Park

(10) Patent No.: US 10,449,464 B2
(45) Date of Patent: Oct. 22, 2019

(54) UMBILICAL CORD STORAGE DOLL AND SET THEREOF

(71) Applicant: Hyunkap Park, Siheung-si (KR)

(72) Inventor: Hyunkap Park, Siheung-si (KR)

( * ) Notice: Subject to any disclaimer, the term of this patent is extended or adjusted under 35 U.S.C. 154(b) by 0 days.

(21) Appl. No.: 15/768,615

(22) PCT Filed: Sep. 1, 2016

(86) PCT No.: PCT/KR2016/009752

§ 371 (c)(1),
(2) Date: Apr. 16, 2018

(87) PCT Pub. No.: WO2017/069400

PCT Pub. Date: Apr. 27, 2017

(65) Prior Publication Data

US 2018/0296934 A1 Oct. 18, 2018

(30) Foreign Application Priority Data

Oct. 21, 2015 (KR) ..... 20-2015-0006834 U

(51) Int. Cl.

| | |
|---|---|
| ***A63H 3/36*** | (2006.01) |
| ***A63H 3/16*** | (2006.01) |
| ***A63H 3/00*** | (2006.01) |
| ***B65D 1/00*** | (2006.01) |

(52) U.S. Cl.

CPC ..... *A63H 3/36* (2013.01); *A63H 3/005* (2013.01); *A63H 3/16* (2013.01); *B65D 1/00* (2013.01)

(58) Field of Classification Search

CPC .. A63H 3/36; A63H 3/16; A63H 3/005; A47F 7/00; A45C 11/00; A45C 13/001; A45C 13/02

See application file for complete search history.

(56) References Cited

FOREIGN PATENT DOCUMENTS

| | | | |
|---|---|---|---|
| JP | S62-040963 | U | 3/1987 |
| JP | 3039316 | U | 7/1997 |
| KR | 20-0204399 | Y1 | 11/2000 |
| KR | 20-0389106 | Y1 | 7/2005 |
| KR | 20-0430741 | Y1 | 11/2006 |
| KR | 20-2012-0003272 | U | 5/2012 |
| KR | 20-2013-0005346 | U | 9/2013 |

*Primary Examiner* — Anthony D Stashick
*Assistant Examiner* — L E Kmet
(74) *Attorney, Agent, or Firm* — Korus Patent, LLC; Seong Il Jeong

(57) ABSTRACT

The present invention provides an umbilical cord storage doll, including: a head part, a torso part, a lower body part, and a storage container, wherein the head part and the torso part are separably coupled to each other and the torso part and the lower body part are separably coupled to each other; wherein the storage container accommodates and stores the umbilical cord therein, and is closed with a stopper; wherein the head part is fabricated via a three-dimensional printer such that the head part looks identical or similar to the face of an actual baby; wherein an upper space is formed in the torso part, a lower space is formed in the lower body part, and the storage container is accommodated throughout the upper space and the lower space; and wherein the torso part and the lower body part are separably coupled to each other by magnetic force.

1 Claim, 6 Drawing Sheets

UMBILICAL CORD STORAGE DOLL AND SET THEREOF

TECHNICAL FIELD

The present invention relates to technology regarding an umbilical cord storage doll, and more specifically to an umbilical cord storage doll and a set thereof which can securely store the umbilical cord by storing a container in which the umbilical cord has been contained therein and which can be kept as a baby's birth souvenir.

BACKGROUND ART

Generally, the umbilical cord is a thin, long, strip-shaped connection between the navel of a fetus and the placenta of a mother, and is a lifeline used to feed oxygen and nutrients required for the fetal growth of a fetus.

The umbilical cord is also referred to as the funiculus umbilicalis in medical terminology. The surface of the umbilical cord is covered with a smooth membrane, two umbilical arteries and one umbilical vein are present inside the umbilical cord, and the umbilical cord is protected by a gelatiginous tissue. Since the umbilical vein grows fast and thus has a long length, the vein is wound around the umbilical arteries and thus has a serpentine shape.

The umbilical cord naturally falls off a baby's navel after a predetermine period has elapsed since the birth of the baby. Meanwhile, the umbilical cord has a special meaning in that it is a lifeline which has connected a mother and a baby for 10 months.

Furthermore, from the past, it has been said that the umbilical cord is a token of luck and fortune comes when the umbilical cord is possessed. In some homes, the umbilical cord was kept deep in a wardrobe. When a person experienced a difficult situation, he or she carried the umbilical cord as a charm.

As described above, as a conventional technology for the storage of the umbilical cord, patent document 1 discloses a seal capable of storing the umbilical cord, the seal including: a cylindrical seal body part configured such that a hole is formed through a side surface thereof and a longitudinal section surface is open; a transparent resin part configured to be inserted into the seal body part and to store the umbilical cord; and an engraving member configured such that a name is engraved on one longitudinal section surface thereof and another longitudinal section surface is inserted into the open longitudinal section surface of the seal body part; wherein the umbilical cord stored in the resin part can be viewed through the hole of the side surface of the seal body part.

Furthermore, patent document 2 discloses a storage container, in which the surface of the lid of a star-shaped appearance is decorated with a simplified Chinese zodiac animal and Chinese character regarding a corresponding year, an inside is partitioned into six compartments, an inner lid made of transparent material is provided to protect and observe the umbilical cord, etc. stored in the inner compartments, the grip of the inner lid is formed using the same star pattern and material as the inner lid and attached to the upper end of the lid, and a Sharon pattern is engraved on the bottom of the inner lid.

Furthermore, patent document 3 discloses an umbilical cord storage album including: a cover configured to include a first cover, a second cover, and a connection cover connecting the first cover and the second cover; an umbilical cord storage part attached to the inner surface of the first cover of the cover, and configured such that a first accommodation portion, a second accommodation portion and a third accommodation portion are formed therein in the form of depressions; a first accommodation container configured to be accommodated in the first accommodation portion of the umbilical cord storage part; a second accommodation container configured to be accommodated in the second accommodation portion; a record storage part attached to the inner surface of the second cover of the cover, and provided with a binder on the inside thereof; an inner album page coupled to the binder provided on the inside of the record storage part, and configured to store a sonogram of a baby; and an inner diary page coupled to the binder provided on the inside of the record storage part, and configured to record the growth of the baby or a feeling when the baby is a fetus.

However, the above-described conventional technologies are used for the purpose of seals unrelated to the umbilical cord or the purpose of simple storage of the umbilical cord, and are not configured such that the face of a baby is embodied in a three-dimensional shape. The above-described conventional technologies are not identified with a baby, and are thus problematic in that an affinity with the technologies is poor and the value of the technologies as a baby's birth souvenir is low.

PRIOR ART DOCUMENTS

Patent Documents (Patent document 1) Korean Utility Model Registration No. 20-0389106 (published on Jul. 7, 2005)

(Patent document 2) Korean Utility Model Application Publication No. 20-2012-0003272 (published on May 11, 2012)

(Patent document 3) Korean Utility Model Application Publication No. 20-2013-0005346 (published on Sep. 11, 2013)

DISCLOSURE

Technical Problem

The present invention has been conceived to overcome the above-described problems, and an object of the present invention is to provide an umbilical cord storage doll and a set thereof in which the face of the umbilical cord storage doll is fabricated to look identical or similar to the face of an actual baby via a 3D printer and a storage container in which the umbilical cord has been accommodated is stored inside the umbilical cord storage doll, so that the precious umbilical cord having kept a mother and a baby together for 10 months can be securely stored and the umbilical cord storage doll can be exhibited and kept as the baby's birth souvenir for a long period of time.

Technical Solution

In order to accomplish the above object, the present invention provides an umbilical cord storage doll including: a head part, a torso part, a lower body part, and a storage container, wherein the head part and the torso part are separably coupled to each other and the torso part and the lower body part are separably coupled to each other; wherein the storage container accommodates the umbilical cord therein, is closed with a stopper at the top thereof, and then stores the umbilical cord; wherein the head part is fabricated via a three-dimensional (3D) printer such that the head part looks identical or similar to the face of an actual baby; wherein an upper space is formed in the torso part, a lower space is formed in the lower body part, and the storage container is accommodated throughout the upper space and the lower space; and wherein the torso part and the lower body part are separably coupled to each other by magnetic force.

In this case, the torso part is configured such that both arms are formed in the state of being attached to the chest.

Furthermore, one or more upper magnets are disposed on the top of the lower body part, and one or more magnetic members are disposed on the bottom of the torso part and are attached to the upper magnet.

Furthermore, the lower body part is configured such that the lower body part is formed in a sitting position with both legs stretched forward in a state of being bent, and one or more lower magnets are disposed on the bottom thereof.

Moreover, a name tag on which any one selected from among a name, birth information, and physical information of the baby has been described is attached to the torso part.

Additionally, the present invention provides an umbilical cord storage doll set including: an umbilical cord storage doll, including: a head part, a torso part, a lower body part, and a storage container, wherein the head part and the torso part are separably coupled to each other and the torso part and the lower body part are separably coupled to each other; wherein the storage container accommodates the umbilical cord therein, is closed with a stopper at the top thereof, and then stores the umbilical cord; wherein the head part is fabricated via a three-dimensional (3D) printer such that the head part looks identical or similar to the face of an actual baby; wherein an upper space is formed in the torso part, a lower space is formed in the lower body part, and the storage container is accommodated throughout the upper space and the lower space; and wherein the torso part and the lower body part are separably coupled to each other by magnetic force; a support plate configured such that the umbilical cord storage doll is seated thereon; and a transparent cover configured to cover a space above the support plate and thus allow the umbilical cord storage doll to be accommodated therein.

In this case, a ring-shaped groove is formed along the periphery of the support plate, the lower end portion of the cover is separably fitted into the groove, and the umbilical cord storage doll and the support plate are separably coupled to each other by magnetic force.

Furthermore, a hat or clothes is worn on the umbilical cord storage doll.

Advantageous Effects

According to the present invention, effects are achieved in that the face of the umbilical cord storage doll is fabricated to look identical or similar to the face of an actual baby via a 3D printer and a storage container in which the umbilical cord has been accommodated is stored inside the umbilical cord storage doll, so that the precious umbilical cord having kept a mother and a baby together for 10 months can be securely stored and the umbilical cord storage doll can be exhibited and kept as the baby's birth souvenir for a long period of time.

MODE FOR INVENTION

In the following, specific details for practicing an umbilical cord storage doll and a set thereof according to the present invention will be described in greater detail with reference to the accompanying drawings with a focus on embodiments.

Figure 1:
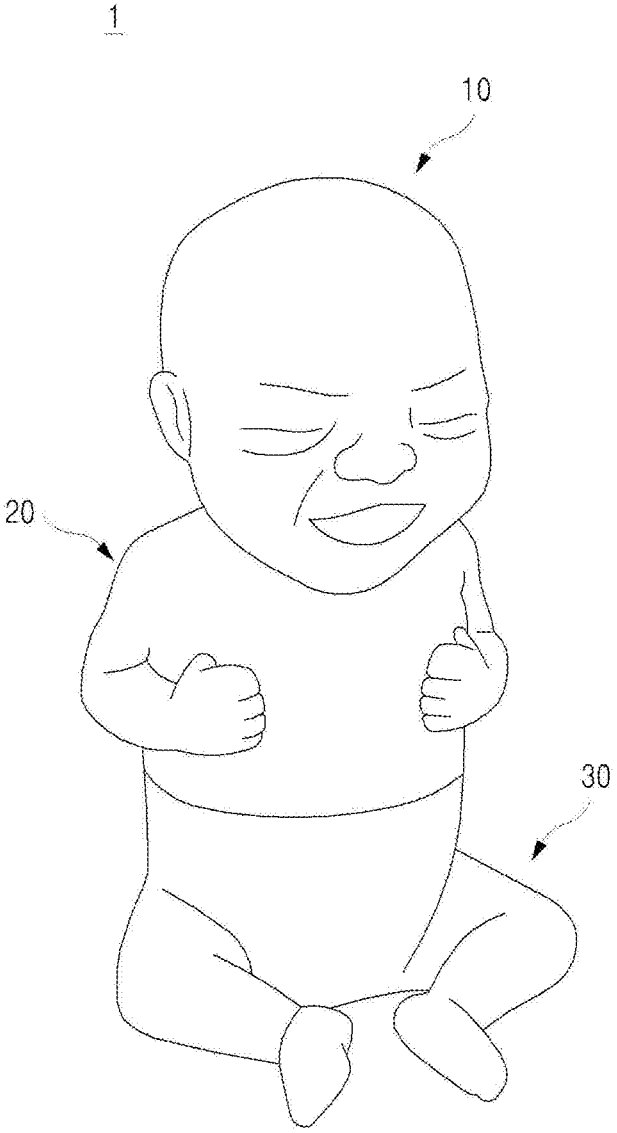
FIG. 1 is a combined perspective view of an umbilical cord storage doll according to an embodiment of the present invention.
Figure 2:
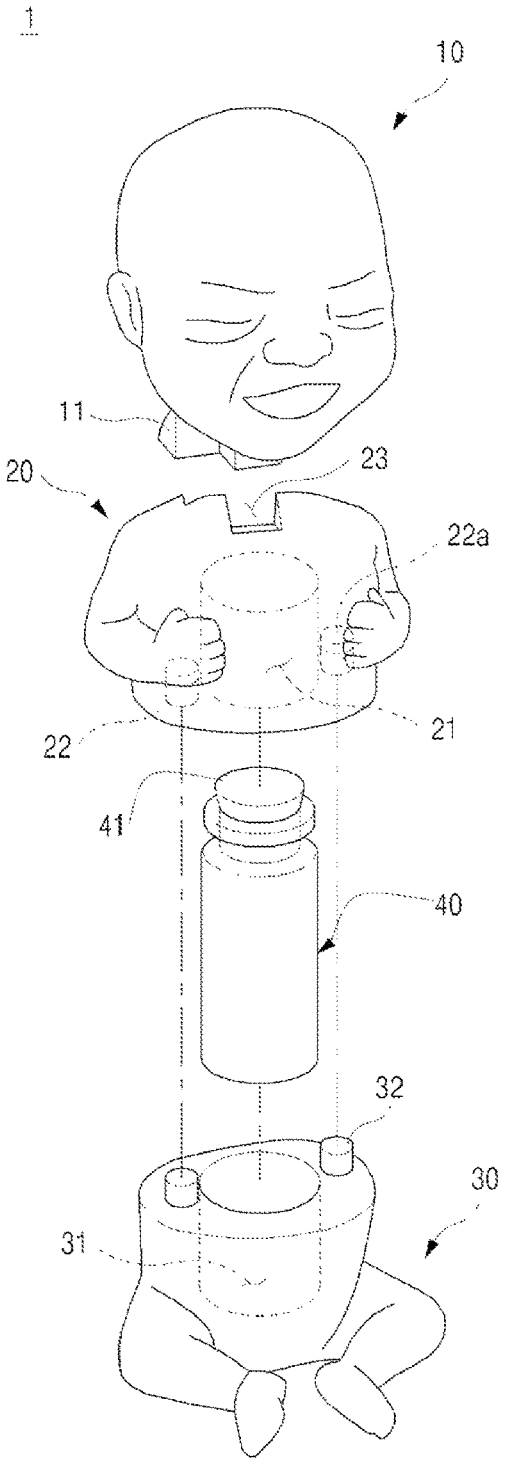
FIG. 2 is an exploded perspective view of the umbilical cord storage doll according to the embodiment of the present invention.

Referring to FIGS. 1 and 2, an umbilical cord storage doll 1 according to the present invention may securely store the umbilical cord by storing a container in which the umbilical cord has been contained therein, and may be kept as a baby's birth souvenir. The umbilical cord storage doll 1 is configured to include a head part 10, a torso part 20, a lower body part 30, and a storage container 40.

The head part 10 constitutes the head of the umbilical cord storage doll 1. The head part 10 is fabricated through output via a 3D printer such that the head part 10 can look identical or similar to the face of an actual baby, and is provided with a coupling protrusion 11 at the lower end thereof such that the head part 10 can be coupled to the coupling depression 23 of the torso part 20.

For this purpose, 3D modeling is performed based on an image, such as a baby's photograph provided by a parent or the like, an output is obtained via a 3D printer, surface processing and post-processing are performed on the output, and the output is painted and fired in an electric kiln.

Furthermore, as a baby grows up, the face of the baby changes gradually. Accordingly, it may be possible to fabricate a new head part having the changed face of the baby, to replace the new head part with the previously fabricated head part, and to couple and use the new head part.

The torso part 20 constitutes the upper body of the baby, and includes both arms. It is preferable that both arms are formed in the state of being attached to the chest because it is similar to the shape of the baby and also possibility that the arms are damaged is low. An upper space 21 configured to accommodate the upper portion of the storage container 40 is formed inside the torso part 20, lower end depressions 22 are formed through the periphery of the lower end of the torso part 20, and magnetic members 22*a* are inserted and installed into the lower end depressions 22.

Figure 3A:
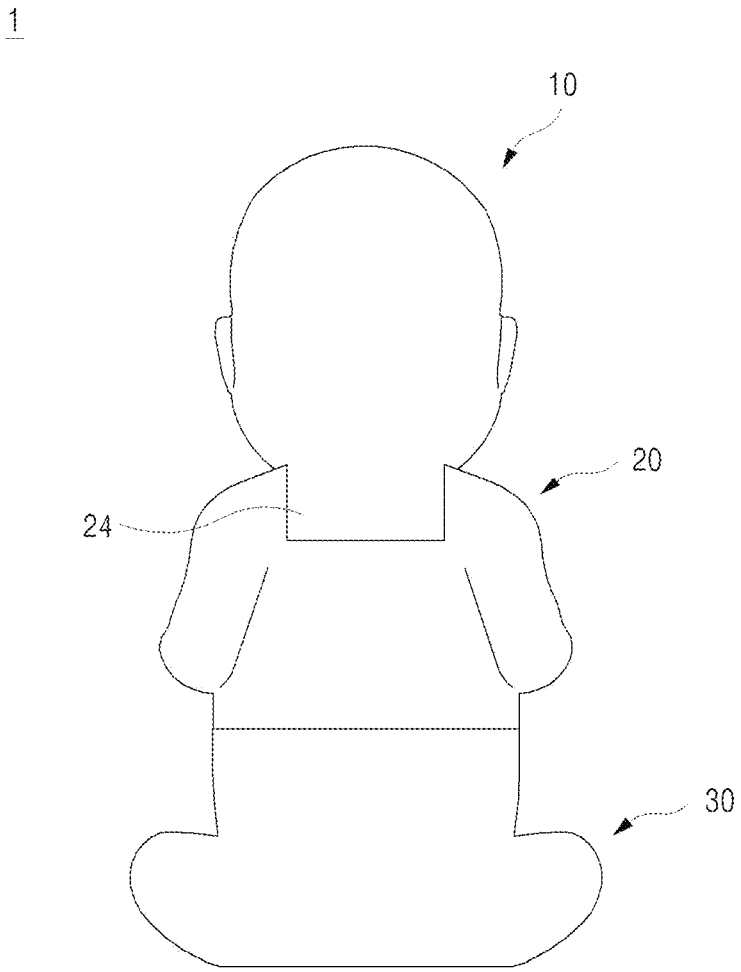
FIG. 3*a* is a rear view of the umbilical cord storage doll according to the embodiment of the present invention.

Moreover, as shown in FIG. 3*a*, a name tag 24 may be attached to the front or back surface of the torso part 20. The name tag 24 is fabricated in a luxurious manner in such a way that the name (Korean or English name) of the born baby, birth information (birth date and time), and physical information (gender, weight, blood type, etc.) are engraved on a metal plate.

The lower body part 30 constitutes the lower body of the baby, and includes both legs. It is preferable for stable placement that both legs are formed in a sitting position. A lower space 31 configured to accommodate the lower portion of the storage container 40 is formed inside the lower body part 30, and upper magnets 32 are installed to protrude upward from the periphery of the upper end of the lower body part 30. Accordingly, the upper magnets 32 are provided to be inserted into the lower end depressions 22 of the torso part 20 and to be separably connected the magnetic members 22*a*, and thus the storage container 40 can be easily accommodated and stored in or removed from the upper space 21 and the lower space 31.

Figure 3B:
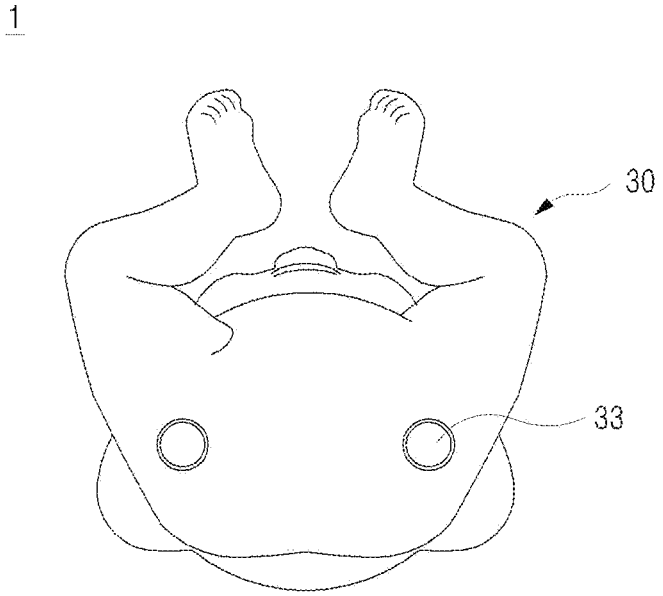
FIG. 3*b* is a bottom view of the umbilical cord storage doll according to the embodiment of the present invention.

Furthermore, as shown in FIG. 3*b*, the lower body part 30 is configured such that lower magnets 33 are formed through the periphery of the lower end thereof and, thus, can be easily attached to a magnetic material, such as a metal material.

Figure 4:
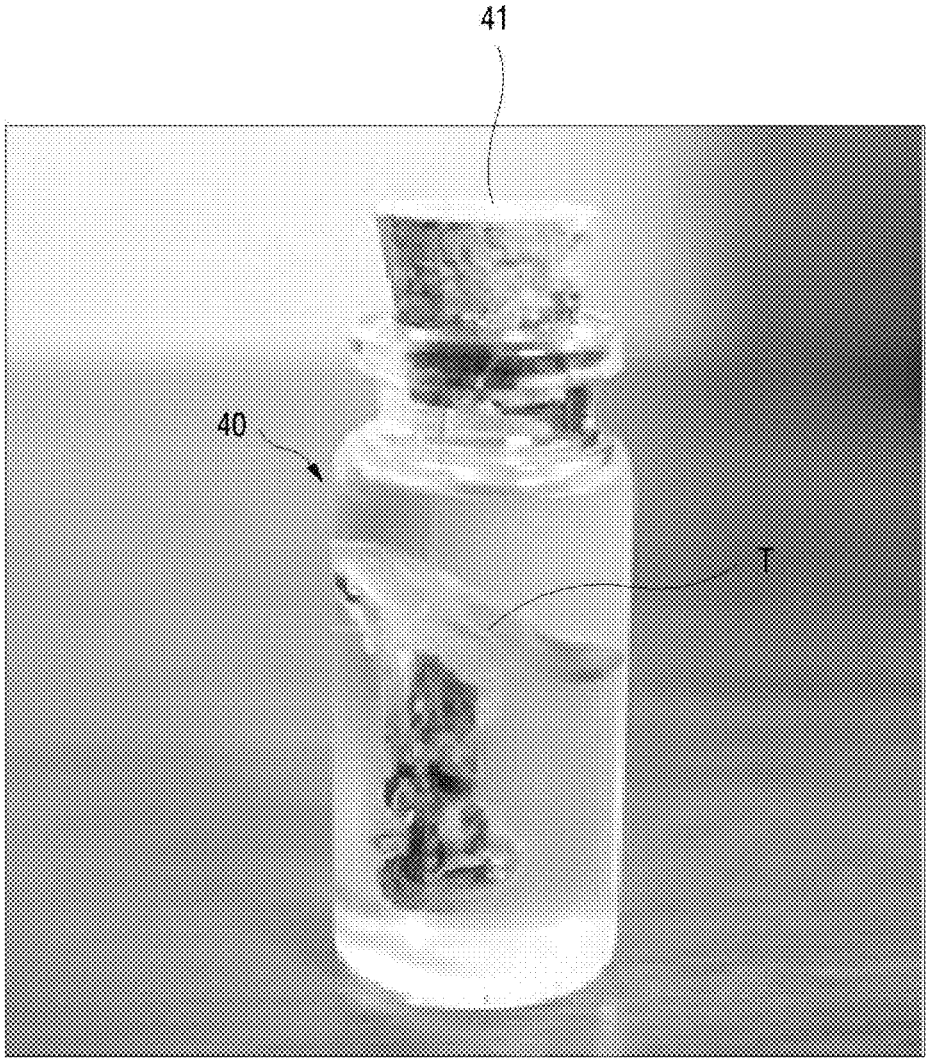
FIG. 4 is a photograph of a storage container in which the umbilical cord and a two-component transparent silicone liquid have been accommodated and hardened according to an embodiment of the present invention.

Referring to FIG. 4, the storage container 40 accommodates the umbilical cord T therein, is closed with a stopper 41 at the top thereof, and stores the umbilical cord T. Since the torso part 20 and the lower body part 30 can be easily separated from each other by magnetic force, the torso part 20 and the lower body part 30 are separated from each other and then the storage container 40 is accommodated in the upper space 21 and the lower space 31.

In this case, in order to securely store the umbilical cord for a long period of time without being deformed by removing odor unique to the umbilical cord and also preventing contact with external air, the umbilical cord is first deposited and stored in alcohol for a few days, is removed from the alcohol and accommodated in the storage container 40, and is then hardened for a predetermined period of time by adding a two-component transparent silicone liquid to the storage container 40, thereby preparing the storage container 40 in which the umbilical cord T has been accommodated in a transparent state, as shown in FIG. 4.

As described above, the face of the umbilical cord storage doll 1 is fabricated to look identical or similar to the face of an actual baby via a 3D printer, and the storage container 40 in which the umbilical cord T has been accommodated is stored inside the umbilical cord storage doll 1. Accordingly, advantages are achieved in that the precious umbilical cord T having kept a mother and a baby together for 10 months can be securely stored and in that the umbilical cord storage doll 1 can be exhibited and kept as the baby's birth souvenir for a long period of time.

Figure 5:
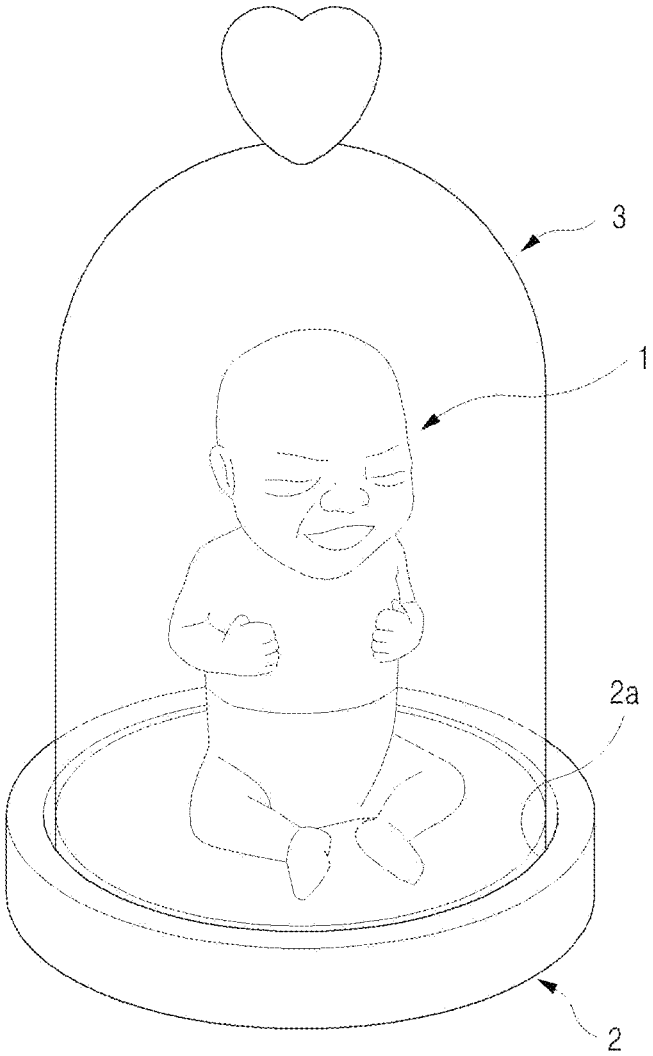
FIG. 5 is a combined perspective view of an umbilical cord storage doll set according to an embodiment of the present invention.

Furthermore, referring to FIG. 5, an umbilical cord storage doll set according to the present invention may be formed in a set, including: the above-described umbilical cord storage doll 1; a support plate 2 configured such that the umbilical cord storage doll 1 is seated thereon; and a transparent cover 3 formed in a "∩" shape, configured to cover a space above the support plate 2 and thus allow the umbilical cord storage doll 1 to be accommodated therein, and made of plastic or glass.

In this case, a ring-shaped groove 2*a* is formed along the periphery of the support plate 2. The lower end portion of the cover 3 is separably fitted into the groove 2*a*. Magnetic members (not shown) are installed on the top of the support plate 2 and, thus, can be separably coupled to the lower magnet 33 of the lower body part 30 of the umbilical cord storage doll 1 by magnetic force.

Moreover, in the umbilical cord storage doll set according to the present invention, the umbilical cord storage doll 1 is exhibited in the state of having worn a hat, clothes, an inner wrapper, or the like and, thus, can provide a more friendly impression to a family. Additionally, a name tag fabricated in a luxurious manner in such a way that the name (Korean or English name) of a born baby, birth information (birth date and time), and physical information (gender, weight, blood type, etc.) are engraved on a metal plate may be placed in front of the doll 1.

In the umbilical cord storage doll and the set thereof according to the present invention, the face of the umbilical cord storage doll is fabricated to look identical or similar to the face of an actual baby via a 3D printer, and the storage container in which the umbilical cord has been accommodated is stored inside the umbilical cord storage doll. Accordingly, the precious umbilical cord having kept a mother and a baby together for 10 months can be securely stored, and the umbilical cord storage doll can be exhibited and kept as the baby's birth souvenir for a long period of time.

DESCRIPTION OF REFERENCE SYMBOLS

1: umbilical cord storage doll
10: head part
11: coupling protrusion
20: torso part
21: upper space
22: lower end depression
22*a*: magnetic member
23: coupling depression
24: name tag
30: lower body part
31: lower space
32: upper magnet
33: lower magnet
40: storage container
41: stopper
2: support plate
2*a*: groove
3: cover
T: umbilical cord

The invention claimed is:

1. An umbilical cord storage doll comprising:

a head part, a torso part, a lower body part, and a storage container, wherein the head part and the torso part are separably coupled to each other and the torso part and the lower body part are separably coupled to each other;

wherein the storage container accommodates an umbilical cord, deposited in alcohol, therein, is closed with a stopper at a top thereof after the umbilical cord has been hardened through addition of a transparent silicone liquid, and then stores the umbilical cord;

wherein the head part is fabricated via a three-dimensional (3D) printer such that the head part looks identical or similar to a face of an actual baby, and is provided with a coupling protrusion at a lower end thereof such that the head part is coupled to a coupling depression formed in a top of the torso part;

wherein the torso part is configured such that both arms are formed in a state of being attached to a chest and an upper space is formed therein, the lower body part is configured such that a lower space is formed therein, and the storage container is accommodated within the upper space and the lower space;

wherein the lower body part is configured such that the lower body part is formed in a sitting position with both legs in a state of being bent, one or more upper magnets are disposed on a top of the lower body part, and one or more lower magnets are disposed on a bottom of the lower body part, the torso part is configured such that one or more lower end depressions are formed on a periphery of an lower end of the torso part, and magnetic members are inserted and installed into the one or more lower end depressions and separably coupled to the upper magnets of the lower body part; and wherein a tag on which any one selected from among a name, birth information, and physical information of the baby has been described is attached to the torso part.

* * * * *